US005522975A

United States Patent [19]

Andricacos et al.

[11] Patent Number: 5,522,975

[45] Date of Patent: Jun. 4, 1996

[54] ELECTROPLATING WORKPIECE FIXTURE

[75] Inventors: Panayotis C. Andricacos, Croton-on-Hudson; Kirk G. Berridge, Fishkill; John O. Dukovic, Pleasantville; Helmut R. Poweleit, Highland, all of N.Y.; Jeffrey S. Richter, Kernersville, N.C.; Lubomyr T. Romankiw, Briarcliff Manor; Otto P. Schick, Poughquag, both of N.Y.

[73] Assignee: International Business Machines Corporation, Armonk, N.Y.

[21] Appl. No.: 441,852

[22] Filed: May 16, 1995

[51] Int. Cl.[6] ..... C25D 17/06

[52] U.S. Cl. ..... 204/297 R; 204/297 M

[58] Field of Search ..... 204/297 R, 297 W, 204/297 M, DIG. 7

[56] References Cited

U.S. PATENT DOCUMENTS

| | | | |
|---|---|---|---|
| 2,987,460 | 6/1961 | Mizia et al. | 204/297 M X |
| 3,481,858 | 12/1969 | Fromson | 204/297 M |
| 3,652,442 | 3/1972 | Powers et al. | 204/273 |
| 4,022,678 | 5/1977 | Wojcik et al. | 204/273 |
| 4,102,756 | 7/1978 | Castellani et al. | 204/43 T |
| 4,428,815 | 1/1984 | Powell et al. | 204/297 W |
| 4,595,478 | 6/1986 | Pellegrino et al. | 204/273 |
| 4,696,729 | 9/1987 | Santini | 204/224 R |
| 5,135,636 | 8/1992 | Yee et al. | 204/DIG. 7 X |
| 5,228,967 | 7/1993 | Crites et al. | 204/228 |
| 5,312,532 | 5/1994 | Andricacos et al. | 204/231 |
| 5,324,410 | 6/1994 | Kummer et al. | 204/297 R X |
| 5,342,495 | 8/1994 | Tung et al. | 204/297 M X |
| 5,405,518 | 4/1995 | Hsieh et al. | 204/297 W X |

FOREIGN PATENT DOCUMENTS 61-177392 8/1986 Japan .

OTHER PUBLICATIONS

Mehdizadeh et al, "Optimization of Electrodeposit Uniformity by the use of auxiliary Electrodes," J. Electrochem. Soc., vol. 137, No. 1, Jan. 1991, pp.:110–117.

Schwartz et al, "Mass–Transfer Studies in a Plating Cell with a Reciprocating Paddle," J. Electrochem. Soc., vol. 134, No. 7, Jul. 1987, pp.: 1639–1645.

Rice et al, "Copper Electrodeposition Studies With a Reciprocating Paddle," J. Electrochem. Soc., vol. 135, No. 11, Nov. 1988, pp.: 2777–2780.

Mehdizadeh et al, "The Influence of Lithographic Patterning on Current Distribution in Electrodeposition: Experimental Study and Mass–Transfer Effects," J. Electrochem. Soc., vol. 140, No. 12, Dec. 1993, pp.: 3497–3505.

*Primary Examiner*—Donald R. Valentine

*Attorney, Agent, or Firm*—Stephen S. Strunck; Francis L. Conte

[57] ABSTRACT

A fixture for supporting a workpiece in a processing cell includes a frame and cooperating workpiece holder. The frame includes a head having a hole therein which receives an integral plateau of the holder. The holder plateau includes an annular seal adjacent a perimeter thereof with a vacuum port disposed therein. The workpiece rests on the seal so that vacuum drawn in the vacuum port fixedly holds the workpiece against the plateau. Assembly of the holder plateau and workpiece thereon through the frame-head hole positions the workpiece coplanar with a front side of the frame. In exemplary embodiments, independent electrical current paths are provided to the workpiece and a surrounding auxiliary electrode.

19 Claims, 14 Drawing Sheets

ELECTROPLATING WORKPIECE FIXTURE

CROSS REFERENCE TO RELATED APPLICATION

This invention is related to patent application Ser. No. 08/441,853, filed May 16, 1995 entitled "Vertical Paddle Plating Cell," filed concurrently herewith.

BACKGROUND OF THE INVENTION

The present invention relates generally to plating and etching, and, more specifically, to a fixture for supporting a workpiece in a plating or etching cell.

Electroplating is a common process for depositing a thin film of metal or alloy on a workpiece article such as various electronic components for example. In electroplating, the article is placed in a suitable electrolyte bath containing ions of a metal to be deposited. The article forms a cathode which is connected to the negative terminal of a power supply, and a suitable anode is connected to the positive terminal of the power supply. Electrical current flows between the anode and cathode through the electrolyte, and metal is deposited on the article by an electrochemical reaction.

Metal deposition on the workpiece may also be accomplished by electroless plating without using a power supply, cathode, and anode. And, workpieces may be etched using either electroetching employing a power supply, or chemical etching without providing a power supply.

In these exemplary processes, the workpiece must be suitably positioned in the processing cells for ensuring uniform plating or etching as desired. In the parent application cross referenced above, an exemplary "Vertical Paddle Plating Cell" (VPPC) is disclosed wherein the workpiece is held in a fixture and suspended in the plating cell for electrodeposition for example. The workpiece fixture introduced therein is the subject of the present application.

SUMMARY OF THE INVENTION

A fixture for supporting a workpiece in a processing cell includes a frame and cooperating workpiece holder. The frame includes a head having a hole therein which receives an integral plateau of the holder. The holder plateau includes an annular seal adjacent a perimeter thereof with a vacuum port disposed therein. The workpiece rests on the seal so that vacuum drawn in the vacuum port fixedly holds the workpiece against the plateau. Assembly of the holder plateau and workpiece thereon through the frame-head hole positions the workpiece coplanar with a front side of the frame. In exemplary embodiments, independent electrical current paths are provided to the workpiece and a surrounding auxiliary electrode.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
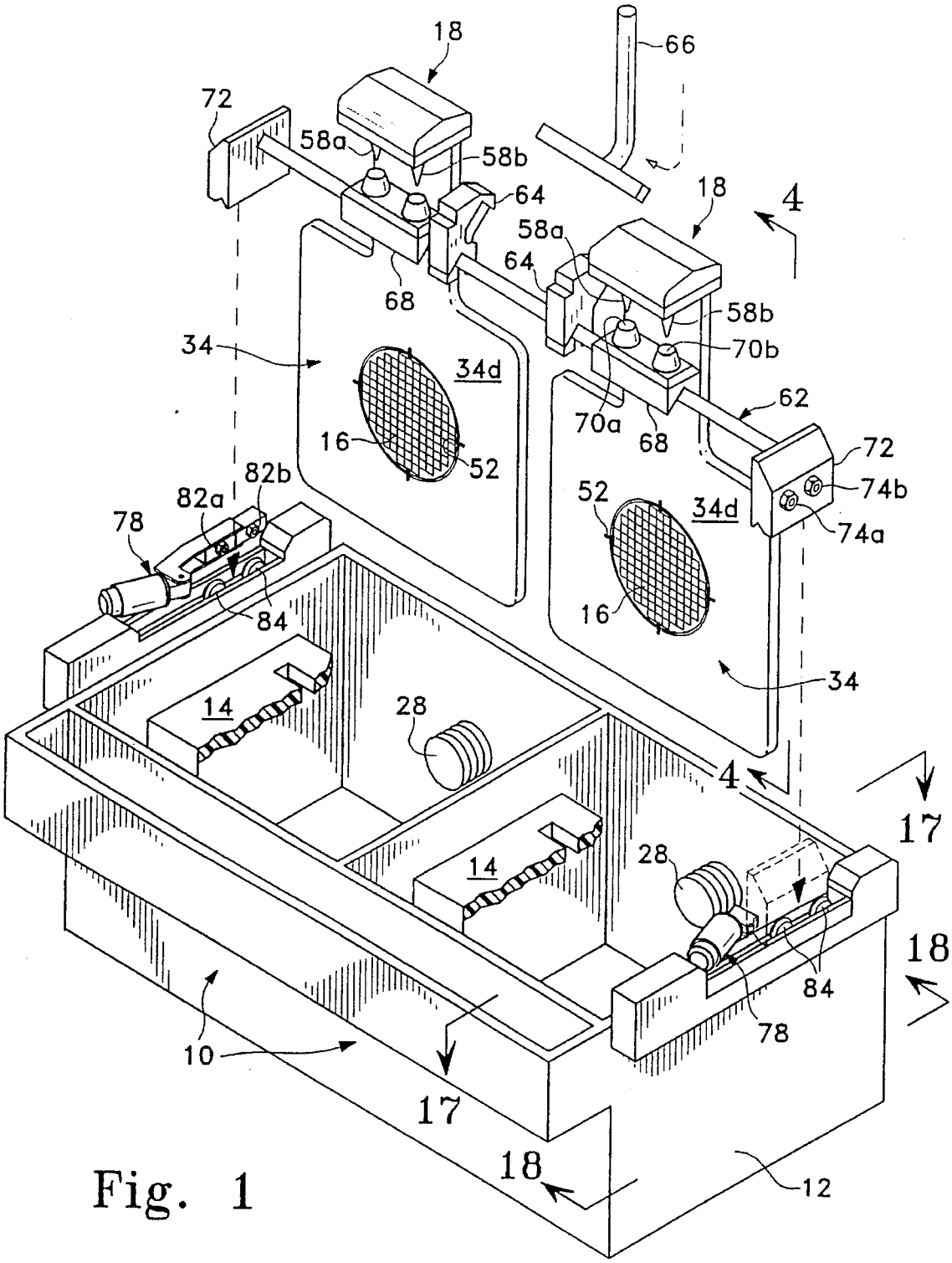
FIG. 1 is a schematic, exploded, perspective view of a pair of identical vertical paddle plating cells having a common housing in which are suspended a pair of identical fixtures for supporting workpieces to be plated.

Illustrated schematically in FIG. 1 are a pair of exemplary and identical vertical paddle plating cells (VPPCs) 10 having a common, bifurcated housing 12. Each of the cells 10 includes an identical inner cell 14 configured for use in electroplating a flat workpiece article 16. The workpiece 16 may take any conventional form that requires uniform plating thickness thereon such as recording heads, packaging modules, or integrated circuits typically used in electronic devices or computers. In the exemplary embodiment illustrated, the workpiece 14 is a flat, circular wafer or ceramic substrate having a substantial number of individual IC chip patterns arranged suitably thereon. In one electroplating process, it is desired to electrodeposit on the several IC chips uniformly thick solder protuberances for example. In this embodiment, the workpiece 16 is relatively fragile and is supported in a workpiece or plating rack or fixture 18 in accordance with the present invention. Two identical fixtures 18 respectively support two identical workpieces 16 for being suspended in the respective plating cells 10 adjacent to the cooperating inner cells 14.

Figure 2:
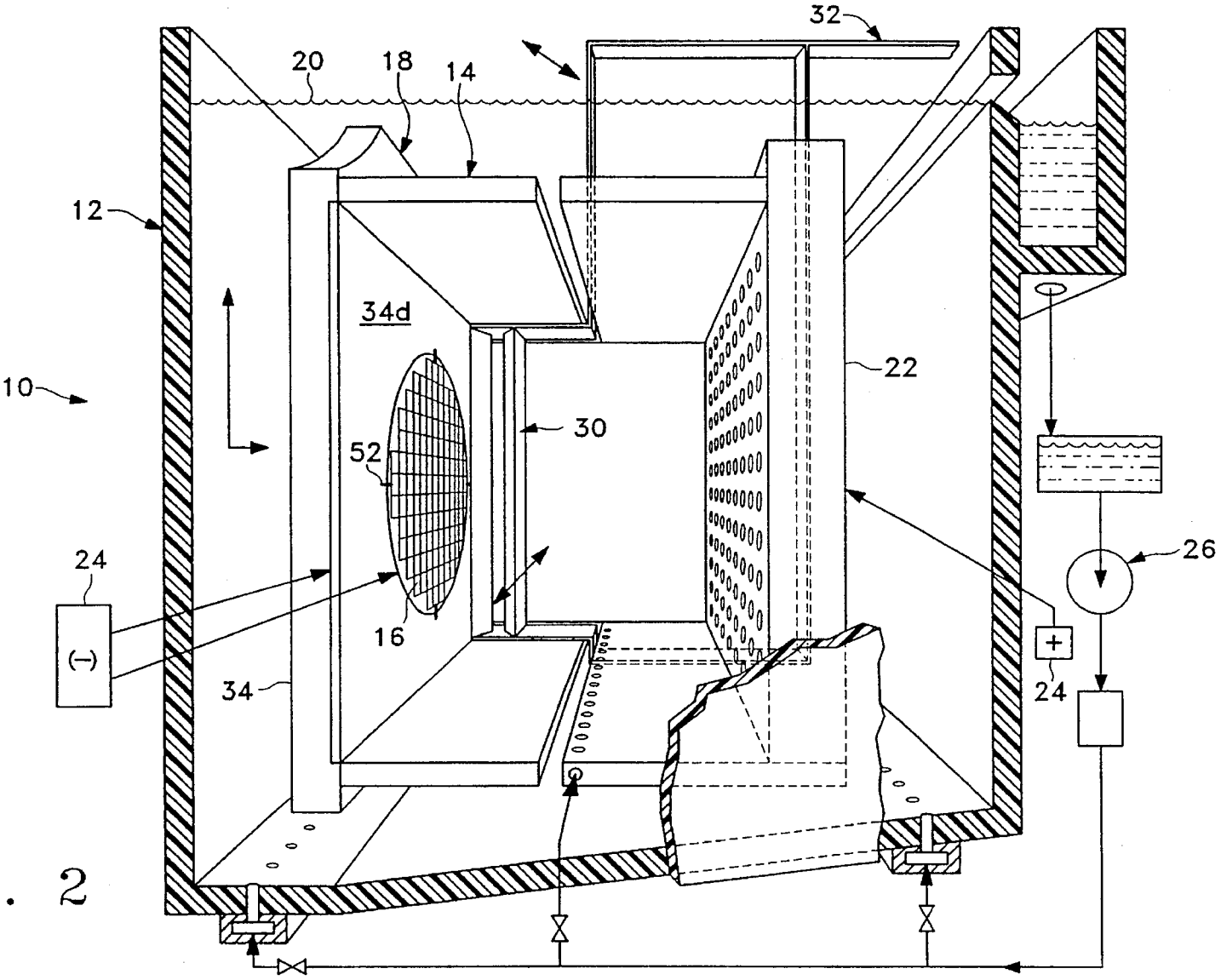
FIG. 2 is a schematic, perspective elevational view of an exemplary one of the plating cells illustrated in FIG. 1 showing one of the workpiece fixtures suspended in position therein.
Figure 3:
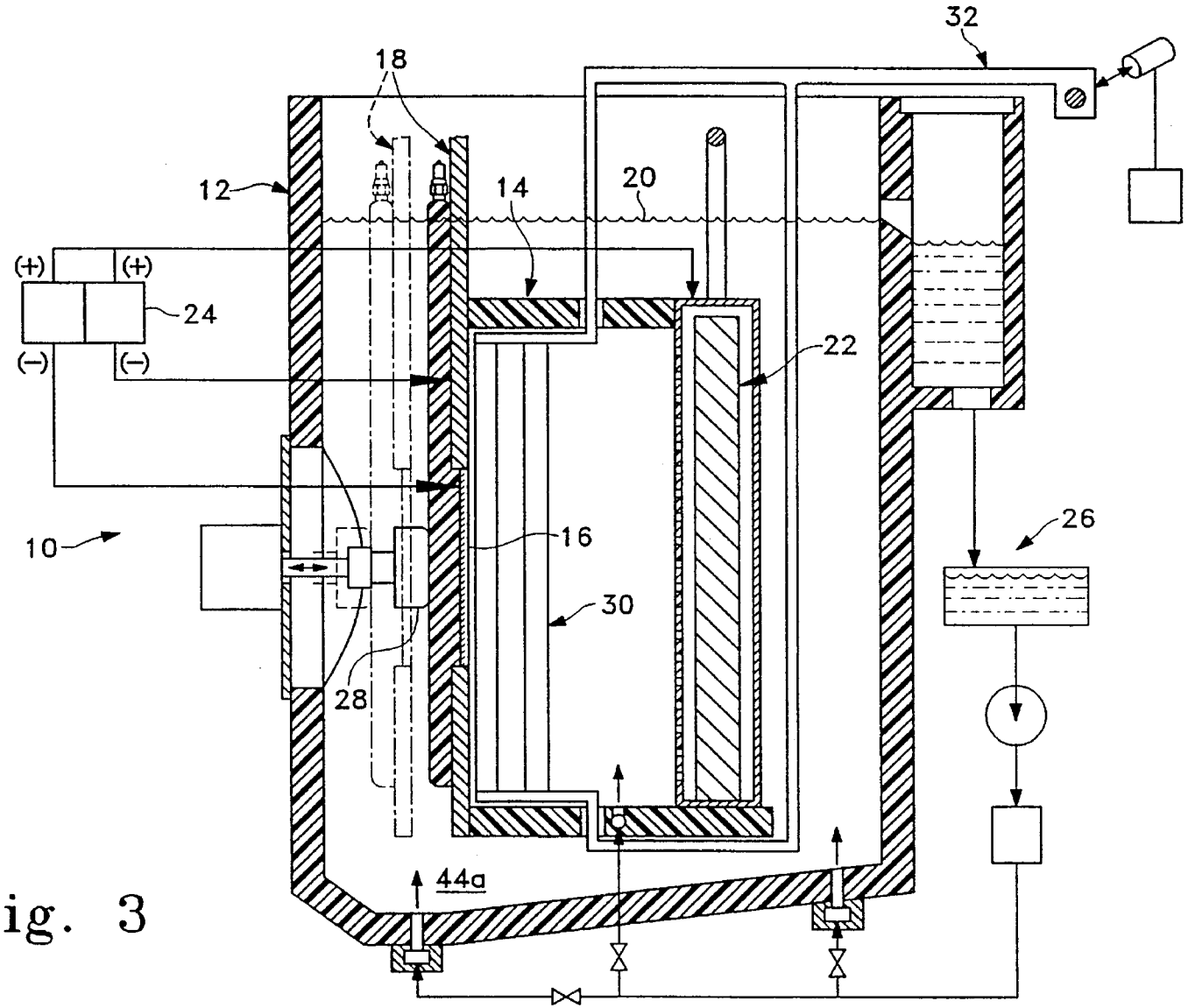
FIG. 3 is a schematic, partly sectional elevational view of the plating cell illustrated in FIG. 2.

More specifically, an exemplary one of the plating cells 10 is illustrated in more detail in FIGS. 2 and 3 and is disclosed in more detail in the "Vertical Paddle Plating Cell" application referenced above. In brief summary, each cell 10 is substantially filled with a suitable liquid electrolyte 20 for electroplating the article 16 upon establishing electrical current flow between the article 16, maintained as a cathode, and an anode 22 in a conventionally known manner. A conventional power supply 24, preferably a two-channel power supply, is operatively connected through suitable electrical lines to the respective workpieces 16 (and thiefs **36*d* described below) for providing a negative electrical potential (cathode), and to the anode 22 for providing a positive electrical potential in accordance with one feature of the present invention as described in more detail below. A suitable electrolyte circulation system 26 includes an external reservoir, flow conduits, pump, filter, and various valves for cleaning and mixing the electrolyte 20 contained in the housing 12**.

Each of the inner cells 14 illustrated in FIGS. 2 and 3 is open at one end for vertically receiving in position thereat the respective workpiece 16 supported in the fixture 18, with an opposite end thereof being closed by the anode 22. The fixture 18 is initially lowered downwardly into the housing 12 adjacent to the inner cell 14, and is then pushed laterally by a suitably actuated piston 28 which secures the fixture 18 in abutting contact against the inner cell 14. During the electroplating process, a vertical, double-prism paddle 30 reciprocates back and forth closely adjacent to the face of the workpiece 16 inside the inner cell 14 by a paddle reciprocating system 32 which includes suitable linkages, actuator, and controller.

A significant advantage of the inner cell 14 and its orientation in space allows for the vertical orientation of both the workpiece 16 in the fixture 18, and the anode 22. This allows relatively easy installation and removal of the fixture 18, with the workpiece 16 thereon, adjacent to the inner cell 14 for allowing automated handling thereof in a high-volume manufacturing line.

Figure 4:
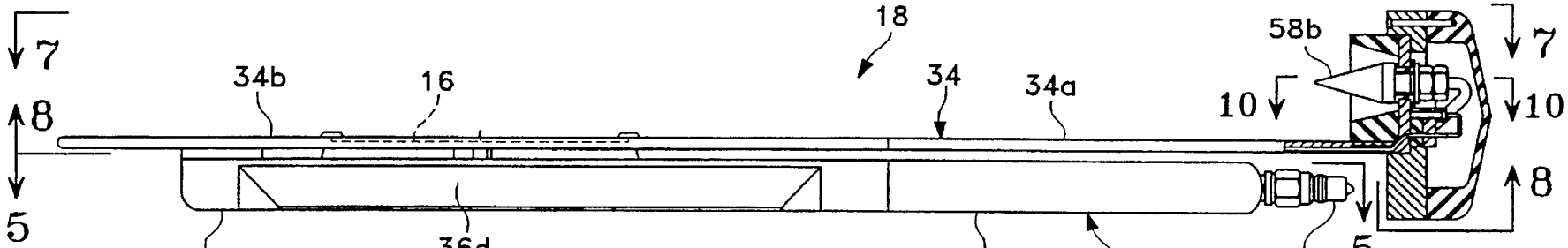
FIG. 4 is a partly sectional, side view of one of the workpiece fixtures illustrated in FIG. 1 and taken along line 4—4 which shows a cooperating frame and holder supporting a workpiece.
Figure 6:
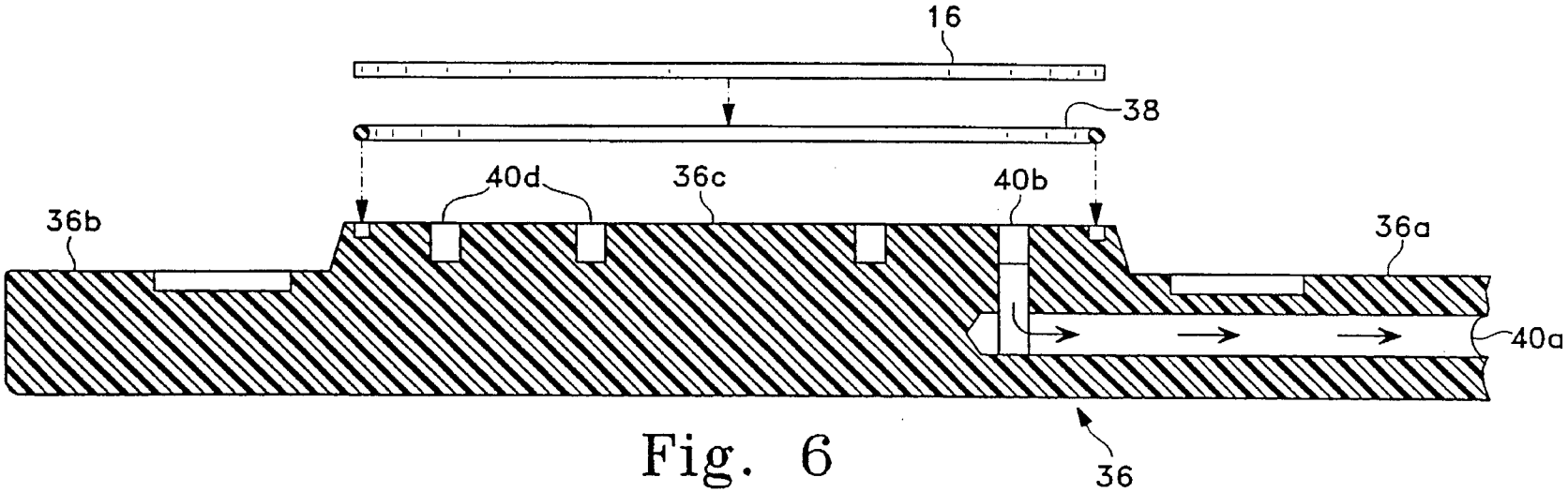
FIG. 6 is an exploded, partly sectional view of the holder plateau and workpiece thereon shown in FIG. 5 and taken along line 6—6.

The fixture 18 is illustrated in FIG. 4 in accordance with an exemplary embodiment of the present invention and includes a frame 34 and a cooperating workpiece holder 36. The holder 36 is illustrated in more particularity in FIGS. 5 and 6 and includes an elongate positioning stem **36*a* and an integral, square and generally flat head 36*b*. In this exemplary embodiment, the holder head 36*b* is configured for supporting a single workpiece 16 and, therefore, includes a centrally located plateau 36*c* extending outwardly from the front side of the holder head 36*b*. In this exemplary embodiment, the workpiece 16 is circular, and therefore the holder plateau 36*c* is also circular and sized for supporting the workpiece 16** adjacent its perimeter.

A suitable elastomeric annular seal 38 in the exemplary form of an O-ring is disposed in a complementary groove adjacent the perimeter of the holder plateau **36*c* for providing a seat to support and seal the workpiece 16 on the plateau 36*c*. The seal 38** may be made of commercially available Viton trade name brand material.

A vacuum tube **40*a* extends through the holder stem 36*a* to a vacuum port 40*b* disposed in the plateau 36*c* within the inner diameter or inside the seal 38. A suitable vacuum valve 40*c* in the exemplary form of a quick-connect, self closing plug valve is disposed at the distal end of the holder stem 36*a* in flow communication with the vacuum tube 40*a* through which a vacuum can be drawn by a suitable vacuum pump 42. The vacuum pump 42 is operatively connectable to the vacuum valve 40*c* for creating a vacuum between the workpiece 16 and the holder plateau 36*c*, which vacuum is maintained by the seal 38 after the pump 42 is disconnected for releasably holding the workpiece 16. In operation, the workpiece 16 is centered over the holder plateau 36*c* and rests atop the seal 38. The vacuum pump 42 is temporarily connected to the vacuum valve 40*c* and a vacuum is drawn for sucking the workpiece 16 against the seal 38 which slightly compresses the seal 38 and supports the backside of the workpiece 16 flat against the plateau 36*c*. The vacuum pump 42 is disconnected from the vacuum valve 40*c* which automatically closes and thusly maintains a vacuum under the workpiece 16 for holding it to the holder plateau 36*c*. The seal 38 maintains the vacuum holding force as well as prevents the undesirable entry of the electrolyte 20 behind the workpiece 16** during operation.

In alternate embodiments, a plurality of concentric seals may be located in the plateau **36*c* and evacuated therebetween for supporting the backside of the workpiece 16 and reducing distortion thereof. Or, a plurality of concentric ridges could be formed in the plateau 36*c* for supporting the backside of the workpiece 16 if desired. In the exemplary embodiment illustrated in FIGS. 5 and 6, the plateau 36*c* includes a plurality of concentric vacuum grooves 40*d* which provide a vacuum reservoir to ensure that the vacuum is maintained over the entire back side of the workpiece 16** for a suitably long period.

Figure 5:
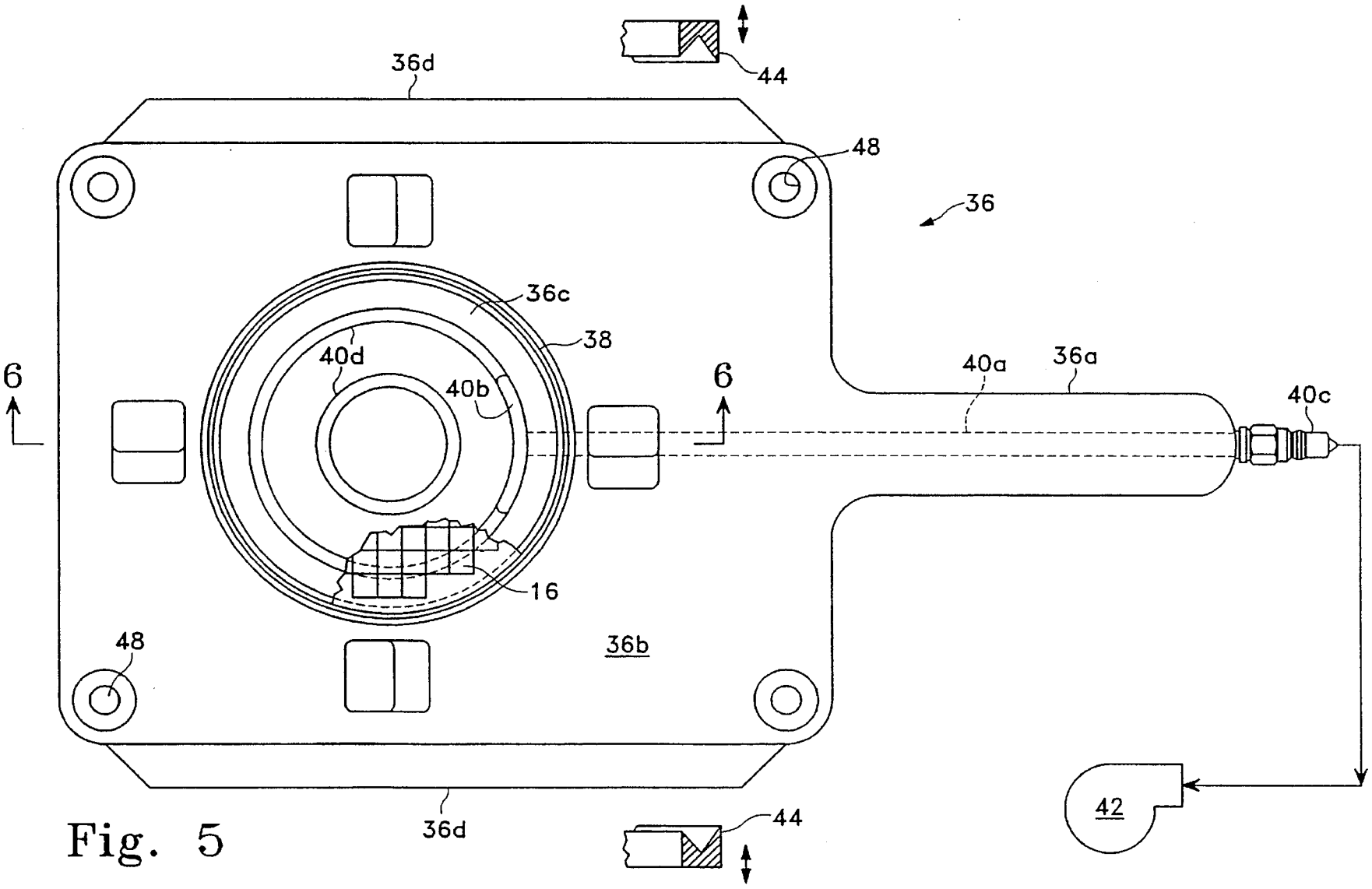
FIG. 5 is a front view of the holder illustrated in FIG. 4 and taken along line 5—5 which includes a central plateau supporting the workpiece thereon.

As shown in FIGS. 4 and 5, the holder 36 may also include generally V-shaped, converging, opposite side edges **36*d* for being releasably held in a complementary robotic grip 44. The grip 44, schematically shown in FIG. 5, may take any suitable and conventional form for grabbing in compression the holder head 36*b* along the side edges 36*d* for automated assembly and disassembly thereof with the frame 34**.

Figure 7:
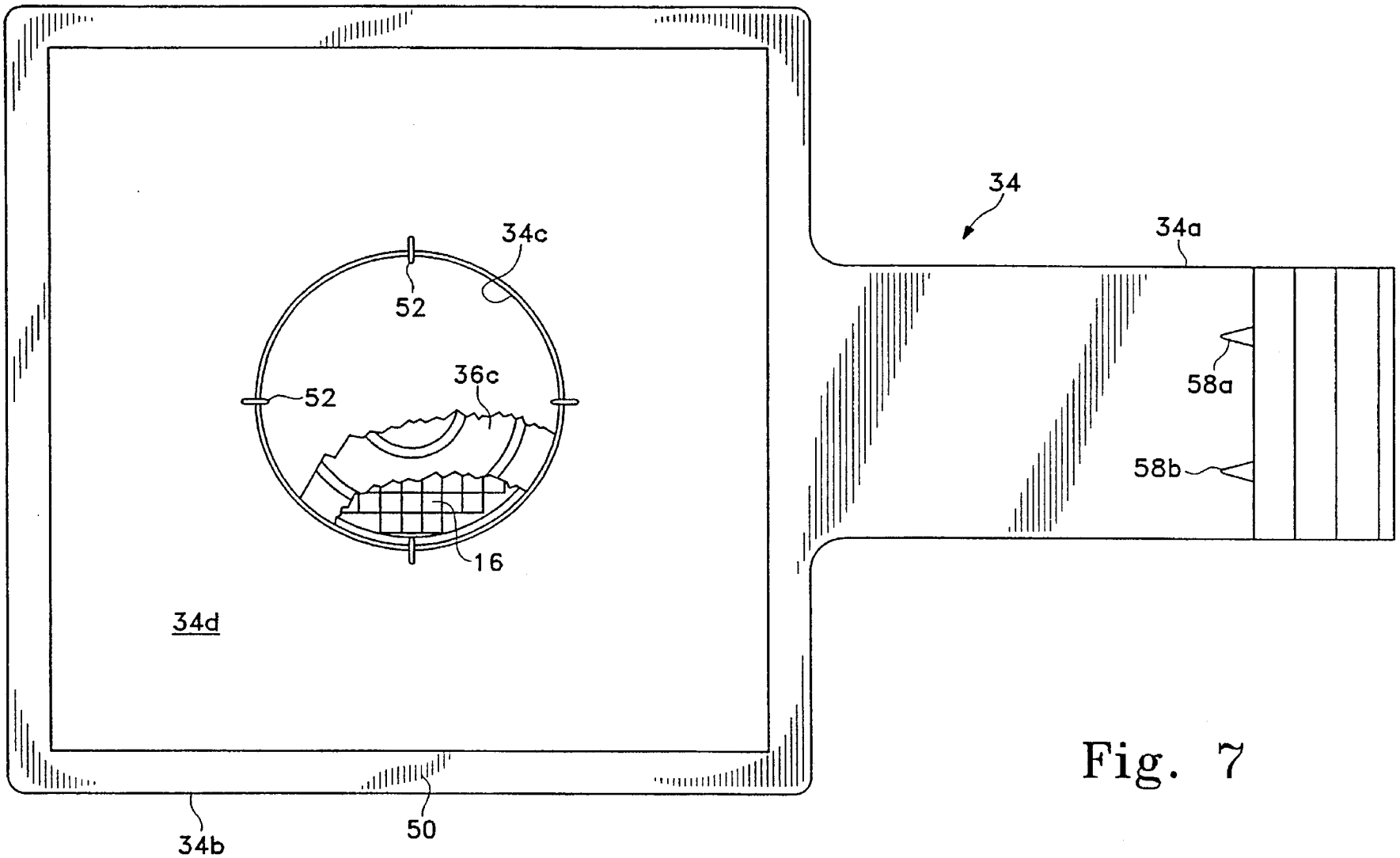
FIG. 7 is a front view of the frame assembly illustrated in FIG. 4 and taken along line 7—7.
Figure 8:
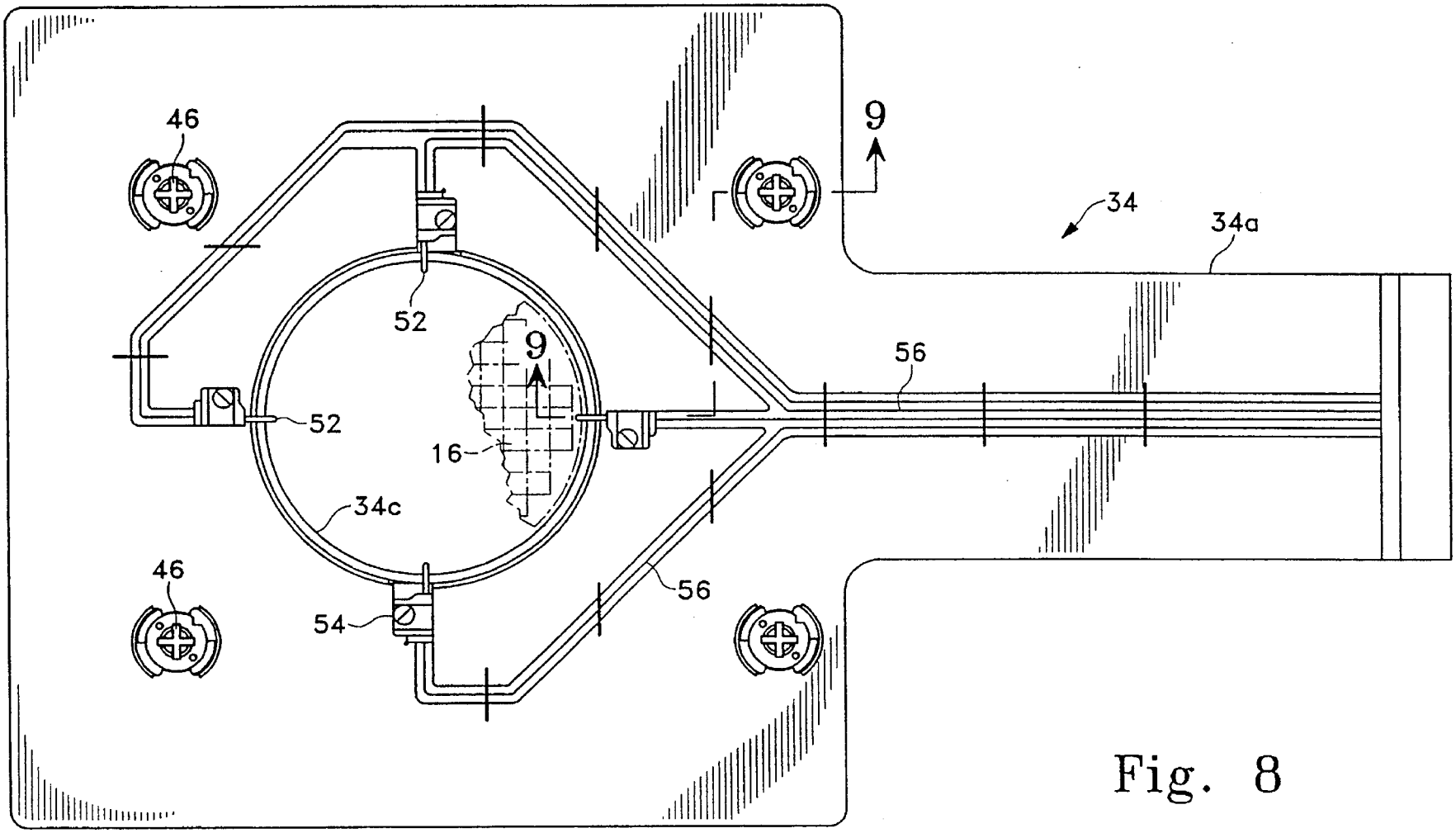
FIG. 8 is a back view of the frame illustrated in FIG. 4 and taken along line 8—8.

The frame 34 is illustrated in an exemplary embodiment in more particularity in FIGS. 7 and 8 and includes an elongate stem **34*a* for removably positioning the frame 34, and the adjoining workpiece holder 36, into the plating cell 10. The frame 34 further includes a generally flat, square head 34*b*, with the frame head 34*b* having a single, central hole 34*c* extending therethrough from front to back sides of the frame 34. The frame-head hole 34*c* is complementary to the holder plateau 36*c*, and to the workpiece 16 held thereon, for receiving the plateau 36*c* to position or align the front side of the workpiece 16 coplanar with the front side of the frame head 34*b*** extending therearound.

Accordingly, the fixture 18 illustrates in FIG. 4 includes the separate frame 34 and holder 36 which mate together for accurately positioning the front side of the workpiece 16 coplanar with the front side of the frame head 34*b* in this exemplary embodiment. Suitable means are therefore required for releasably fixedly joining the holder 36 to the frame 34, with the plateau 36*c* being disposed in the frame-head hole 34*c*. More specifically, FIG. 8 illustrates a plurality of snap plugs 46 fixedly joined to the back side of the frame head 34*b*. In this exemplary embodiment, four snap plugs 46 are spaced apart from each other at generally the four corners of the frame head 34*b*.

Figure 9:
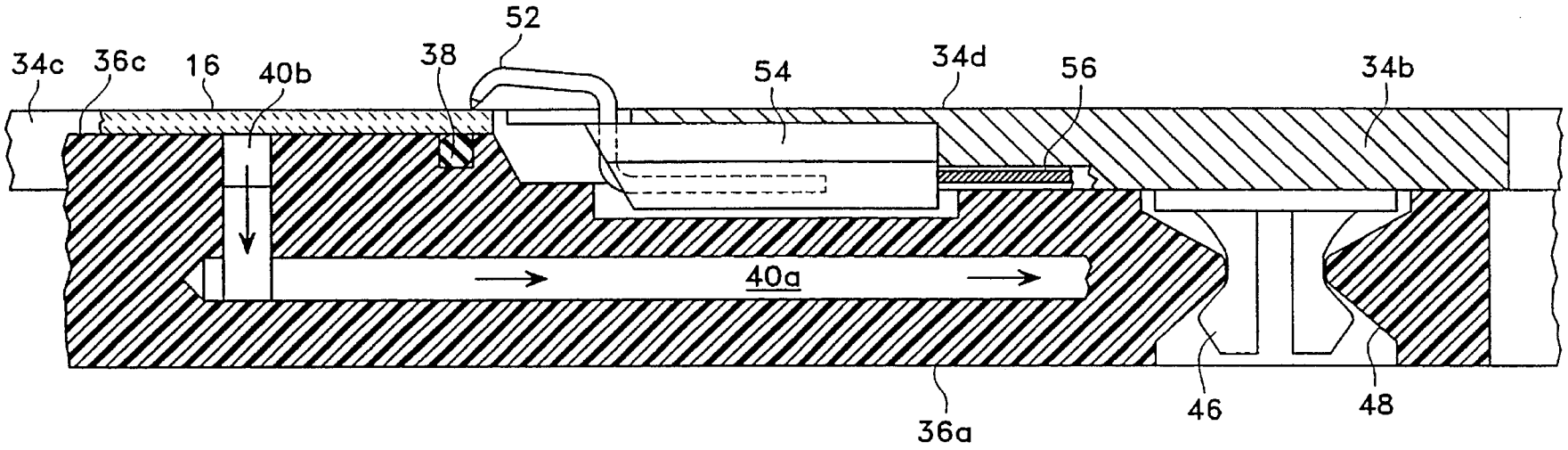
FIG. 9 is an enlarged, transverse sectional view through the frame and cooperating holder illustrated in FIG. 8 and taken along line 9—9.

FIG. 5 illustrates a corresponding plurality of cooperating snap holes 48 disposed at the four corners of the holder head 36*b*. FIG. 9 illustrates in more particularity an exemplary pair of the engaged snap plugs 46 and snap holes 48. Each snap plug 46 has a bulbous distal end and is split in a cross fashion to define four flexible fingers. The cooperating snap hole 48 is complementary in configuration and has a generally hour-glass transverse section with its inner diameter being less than the outer diameter of the bulbous distal end of the snap 46. In this way, when the holder plateau 36*c* is inserted into the frame-head hole 34*c*, the snaps 46 correspondingly contract and expand through the snap holes 48 for locking together the frame 34 and the holder 36. The frame 34 and the holder 36 may be easily disassembled from each other by simply pulling these components apart which disengages the cooperating snap plugs 46 and snap holes 48. The snaps 46 as shown in FIG. 8 may be mounted to the frame head 34*b* using conventional bayonet-type joints which require merely a quarter-turn for inserting and locking each snap plug 46 to the frame head 34*b*. In this way, the snap plugs 46 may be readily removed and replaced with snap plugs having different lengths for accommodating workpieces 16 having different thicknesses which require the mounting thereof coplanar with the front side of the frame head 34*b*.

The fixtures 18 illustrated in FIG. 1 are specifically configured for supporting the workpieces 16 for electroplating thereof. Accordingly, suitable electrical current paths are separately provided to the workpieces 16 to establish negative potentials thereat and forming cathodes. In the exemplary embodiment illustrated in FIG. 5, the entire workpiece holder 36 is preferably formed of a suitable plastic material which is a dielectric or electrical insulator as well as being resistant to corrosion from the electrolyte 20. For example, the holder 36 may be formed of polyvinylidene fluoride (PVDF).

In the exemplary embodiment illustrated in FIG. 7, the frame 34 is preferably formed of an electrically conducting metal such as stainless steel for providing an electrical current path directly therethrough. Also as shown in FIG. 7, the frame 34 includes in this electroplating embodiment an auxiliary electrode or cathode thief 34*d* disposed on the front side of the frame head 34*b* around the frame-head hole 34*c*. The thief 34*b* is preferably an integral portion of the frame head 34*b* and is uncoated for providing an auxiliary electrode current path through the electrolyte 20 when positioned across the inner cell 14 as illustrated in FIG. 2. Both the front and back sides of the frame 34 are preferably coated with a suitable dielectric material 50, such as that commercially available under the Halar trade name, except for the square area of the thief 34*d* surrounding the frame-head hole 34*c* which matches the square configuration of the inner cell 14. In this way, the metallic frame is itself electrically conducting for providing a direct and integral electrical current path to the thief 34*d*. The dielectric coating 50 suitably electrically insulates the remainder of the frame 34 and prevents undesirable electroplating thereof which would adversely affect electroplating rate uniformity of the workpiece 16.

In order to provide an independent and separate electrical current path to the cathodic workpiece 16 positioned in the frame-head hole 34*c*, a plurality of electrical contact pins 52, as shown in FIGS. 7 and 8 for example, are circumferentially spaced apart around the frame-head hole 34*c* for electrically contacting the top side of the workpiece 16 when the holder 36 is joined to the frame 34.

FIGS. 8 and 9 illustrate in more particularity the electrical current path provided by the contact pins 52. In this exemplary embodiment, four contact pins 52 are equally spaced apart from each other around the circumference of the frame-head hole 34*c*. Any suitable number of the pins 52 may be used, and suitably spaced as desired such as the orientation shown in FIG. 8, or the reorientation thereof 45° counterclockwise for example. Each contact pin 52 is in the general form of a hook with a low-profile distal end projecting slightly outwardly above the front surface of the thief 34*d* for minimizing interference of the flow of the electrolyte 20 thereover, and includes a generally straight proximal end which is removably positioned in a complementary pin housing 54. The pin housing 54 is suitably fixedly joined in a recess in the backside of the frame-head 34*b* and allows for ready replacement of the individual pins 52.

Each pin 52 is preferably coated with a dielectric such as that available under the Halar trade name except for the tip of the distal end or portion which abuts the top surface of the workpiece 16 for establishing an electrical current path therewith. The distal end of the pin 52 is suitably flexible so that it may be slightly elastically bent upon assembly of the frame 34 and the holder 36 for providing good electrical contact with the workpiece 16; for accommodating manufacturing tolerances; and for providing additional retention of the workpiece 16 against the holder plateau 36*c*. A plurality of electrical lines or wires 56 are joined to respective ones of the contact pins 52 through the housings 54 for providing separate current paths to each of the pins 52. The electrical lines 56 are suitably channeled and secured in corresponding troughs formed in the back side of the frame 34 to protect the lines 56 therein which are suitably electrically insulated therefrom.

Figure 10:
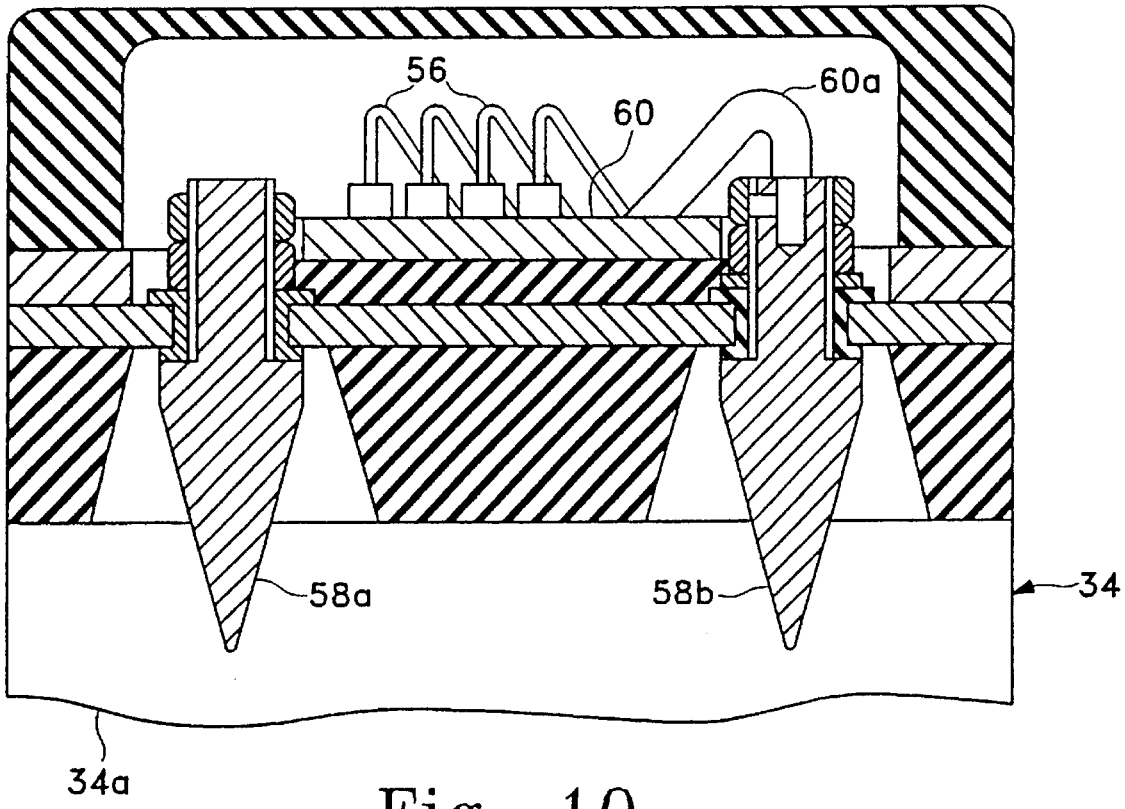
FIG. 10 is a partly sectional, elevational view through the top end of the frame illustrated in FIG. 4 and taken along line 10—10.
Figure 11:
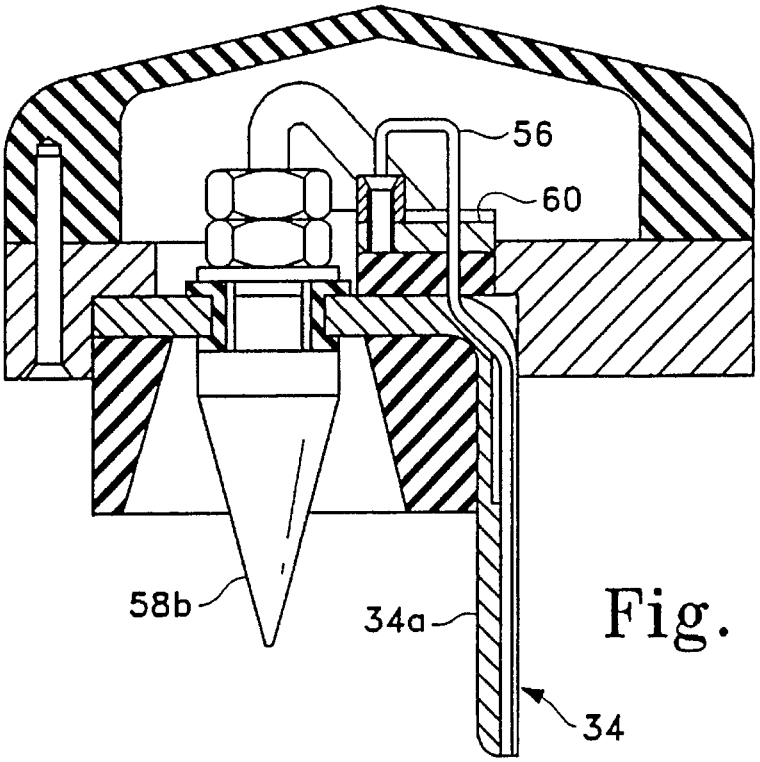
FIG. 11 is an enlarged, partly sectional elevational view of the top end of the frame illustrated in FIG. 4.

As shown in FIGS. 10 and 11, the frame 34 further includes first and second electrical contact cones 58*a* and 58*b* fixedly joined to the distal or top end of the frame stem 34*a*. The two cones 58*a,b* are aligned parallel with the frame stem 34*a* and point downwardly toward the frame head 34*b* as additionally shown in FIG. 4. The two cones 58*a,b* allow the entire fixture 18 to be vertically suspended in the plating cell 10 as illustrated in FIG. 1 while providing automatic electrical connections to the thief 34*d* and the contact pins 52. Referring again to FIGS. 10 and 11, the first cone 58*a* is suitably directly electrically joined to the frame stem 34*a* for providing a direct current path to the thief 34*d*. The second cone 58*b* is suitably electrically insulated from the frame stem 34*a*, but is electrically joined to the plurality of electrical lines 56 for providing separate current paths to the contact pins 52.

In the exemplary embodiment illustrated in FIGS. 10 and 11, each of the four electrical lines 56 is joined to a common bussbar 60, with the bussbar 60 being in turn electrically connected to the second cone 58*b* by a main line 60*a*. The bussbar 60 is suitably electrically insulated from the frame stem 34*a* so that an independent current path is provided through the second cone 58*b* to the several electrical lines 56 joined to the bussbar 60 without shorting to the first cone 58*a* and the frame 34. In this way, the two cones 58*a,b* provide independent electrical current paths to the thief 34*d* and the contact pins 52, respectively. Other suitable arrangements for electrically joining the two cones 58*a,b* to the thief 34*d* and pins 52 may be used as desired.

For example, each of the electrical lines 56 is preferably removably plugged into mating holes in the bussbar 60 as shown in side profile in FIG. 11 so that each of the lines 56 may be separately disconnected preferably in pairs for testing continuity through their respective contact pins 52 and the workpiece 16 in contact therewith. This ensures that the pins have good electrical contact with the workpiece 16. The electrical connections behind the cones 58*a,b* are readily accessible by removing a dielectric cover when testing is desired.

In order to suspend and provide electrical connections to the fixtures 18, an elongate flybar 62 is provided for straddling or spanning the two cells 10 as shown in FIG. 1, or more as desired. Although the flybar 62 may be configured for supporting an individual fixture 18 in a respective plating cell 10, in the exemplary embodiment illustrated in FIG. 1, the flybar 62 is configured for identically supporting two fixtures 18 in their respective plating cells 10. The flybar 62 is illustrated in more particularity in FIGS. 12 and 13 and includes an elongate support beam 62*a* which is sized in length for straddling both plating cells 10 across the common housing 12.

Figure 14:
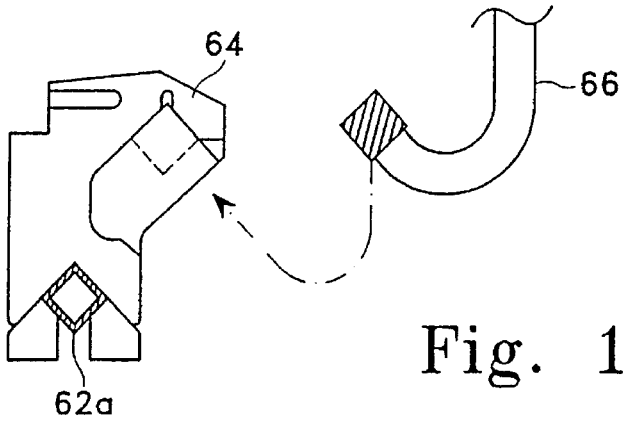
FIG. 14 is a side view of one of a pair of support hangers joined to the flybar illustrated in FIG. 12 and taken along line 14—14.
Figure 15:
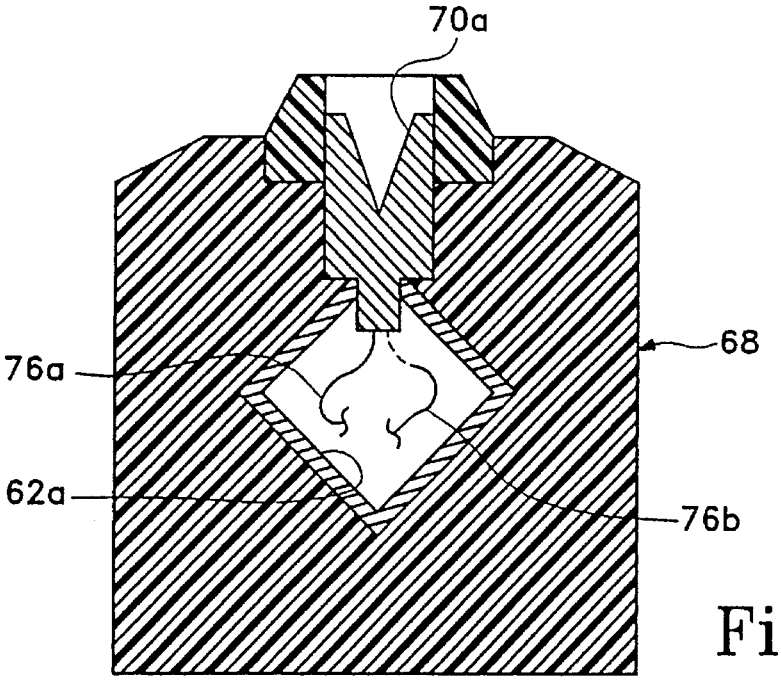
FIG. 15 is an elevational, sectional view through one of a pair of support blocks fixedly joined to the flybar illustrated in FIG. 12 and taken along line 15—15.

The flybar 62 includes a pair of axially spaced apart support hangers 64 suitably fixedly joined thereto for lifting the flybar 62 and in turn lifting the two fixtures 18 supported thereon. The hangers 64 are illustrated in FIG. 1 adjacent to a lifting hook 66 having a T-shaped distal end which is readily inserted into the cooperating support hangers 64 as shown in more particularity in FIG. 14. The flybar support beam 62*a* is preferably square in transverse section for increasing torque resistance between it and the support hangers 64 for minimizing any swinging of the fixtures 16 supported on the flybar 62 as they are carried to or away from the plating cells 10.

Figure 12:
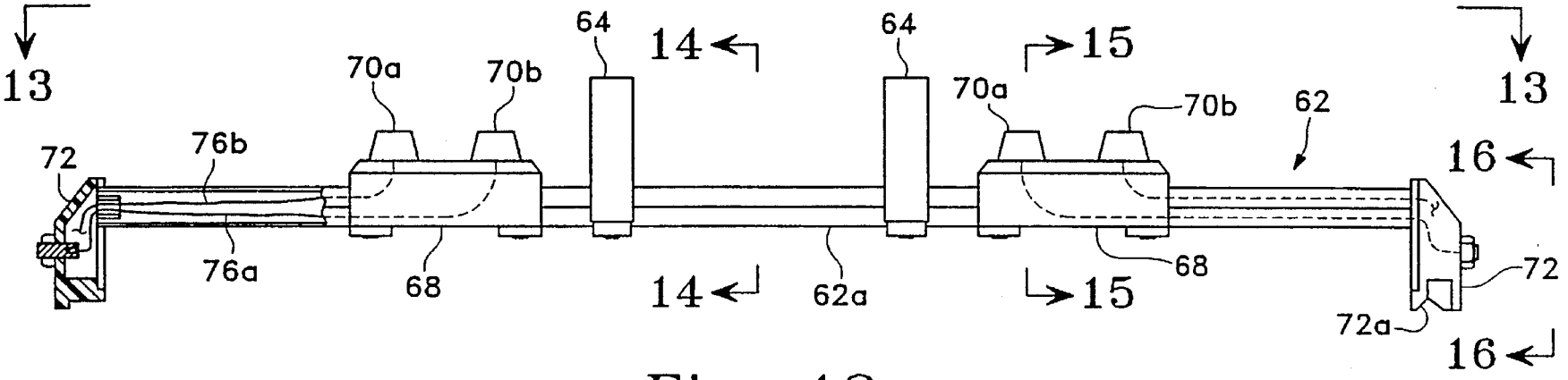
FIG. 12 is a partly sectional, front view of a flybar shown in FIG. 1 for supporting the two workpiece fixtures thereon.
Figure 13:
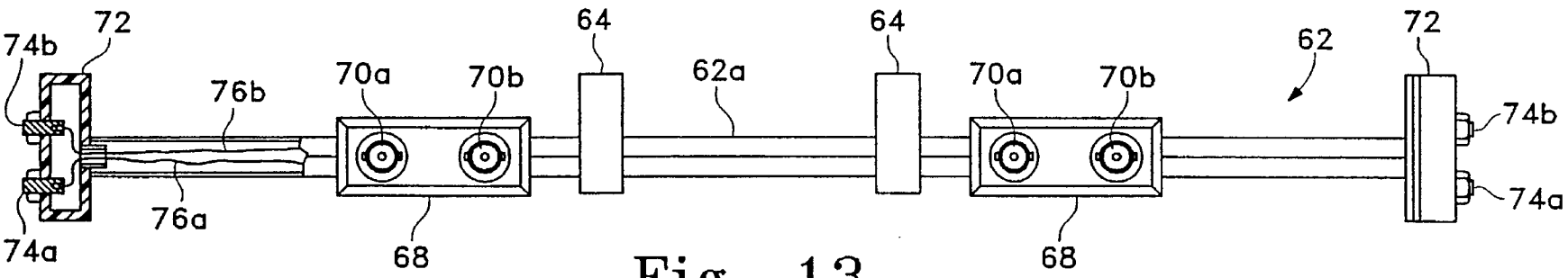
FIG. 13 is a partly sectional, top view of the flybar illustrated in FIG. 12 and taken along line 13—13.

As shown in FIGS. 12 and 13, the flybar 62 further includes a pair of identical support blocks 68 suitably fixedly joined to an intermediate section of the support beam 62*a* on respective sides of the hangers 64. Each of the support blocks 68 includes first and second electrically conductive conical receptacles 70*a* and 70*b* for respectively receiving the downward pointing first and second cones 58*a,b* at the top of the fixture 18. In this way, each fixture 18 may be readily loaded downwardly atop its respective support block 68, with the cooperating cones 58*a,b* and receptacles 70*a,b* providing an effective and accurate interconnection. The support hangers 64 straddle the center of the flybar 62, with the support blocks 68 being equally disposed outboard thereof so that the two fixtures 18 are balanced on the flybar 62 for allowing lifting thereof by the centrally located lifting hook 66.

The flybar 62 is loaded atop the common housing 12 of the plating cells 10 and includes a pair of endblocks or endcaps 72 which are suitably fixedly joined to opposite ends of the support beam 62*a*. At least one, and preferably both of the endcaps 72 includes first and second electrical contact buttons 74*a* and 74*b* as shown in more particularity in FIGS. 13 and 16. The buttons 74*a,b* are suitably electrically joined to respective ones of the receptacles 70*a,b* by corresponding first and second electrical wires 76*a* and 76*b* which may be conveniently channeled through the flybar support beam 62*a* by making it hollow. The buttons 74*a,b* of each of the endcaps 72 are preferably separately wired to respective ones of the receptacles 70*a,b* of the support blocks 68 for providing independent electrical current paths thereto.

As shown in FIGS. 1 and 12, the first and second receptacles 70*a,b* are disposed on the support blocks 68 to face upwardly for receiving downwardly therein respective ones of the first and second cones 58*a,b* for both supporting or suspending the fixtures 18 by the frames 34, as well as for providing automatic (by gravity) electrical contact by joining together in abutting contact the first cone 58*a* and the first receptacle 70*a*, and the second cone 58*b* and the second receptacle 70*b*. The support hangers 64, support blocks 68, and endcaps 72 are preferably formed of a suitable material which is a dielectric and resistant to corrosion by the electrolyte 20, such as PVDF.

In order to provide separate electrical current paths through the flybar 62 to the respective fixtures 18 suspended therefrom, at least one, and preferably two clamping assemblies, or simply clamps 78 are mounted atop both ends of the housing 12 for completing the current paths as shown in FIG. 1 for example. The clamps 78 are identical and an exemplary one thereof is illustrated in more particularity in FIGS. 17 and 18. Each clamp 78 includes a frame 78*a* fixedly joined to the top of the housing 12 along one side thereof, and a clamping arm 78*b* pivoted at an intermediate portion thereof to the frame 78*a*. An actuator 78*c* is operatively joined to a proximal end of the clamping arm 78*b* and is effective for pivoting the clamping arm 78*b* to engage the flybar endcap 72 in axial compression. The actuator 78*c* may be a conventional pneumatic actuator operated and controlled by a suitable air drive 80 operatively joined thereto.

The distal end of the clamping arm 78*b* includes a pair of spaced apart first and second electrical supply terminals 82*a* and 82*b*. The clamp 78 is selectively positionable to clamp the flybar 62 in axial compression, which the first button 74*a* and the first terminal 82*a* abutting together to establish the current path to the thief 34*d* through the intermediary electrical joints; and the second button 74*b* and the second terminal 82*b* abut together to establish the separate current path to the contact pins 52 through the respective intermediary electrical joints.

Figure 17:
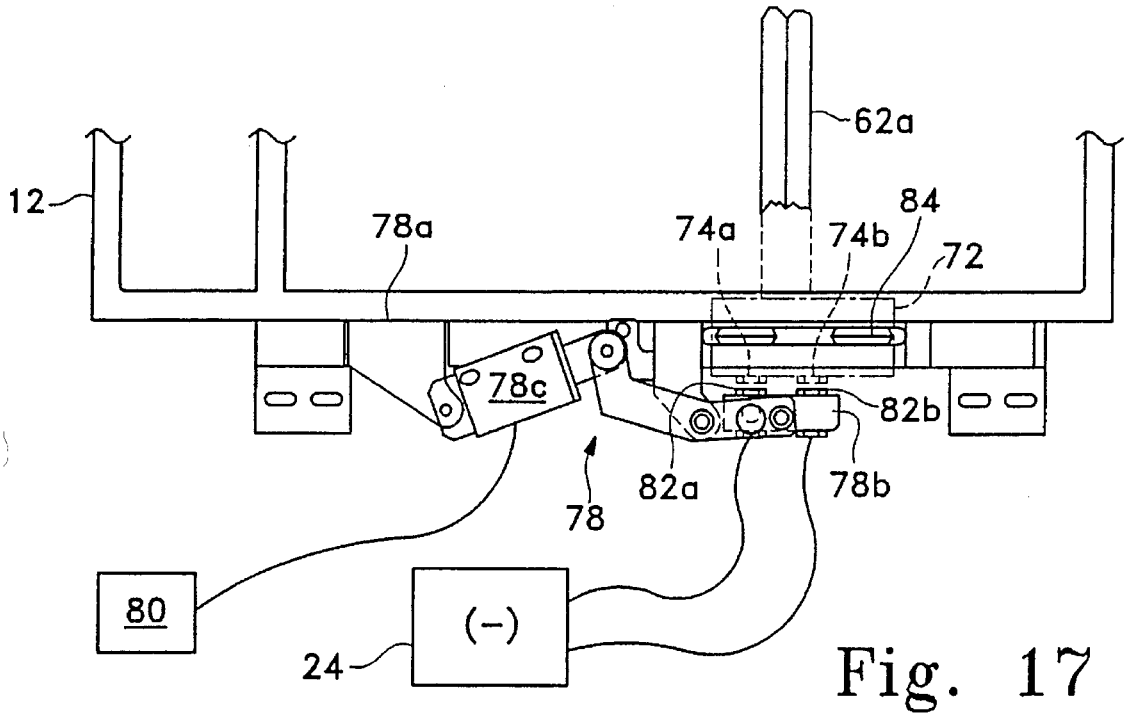
FIG. 17 is a top view of one of a pair of clamps joined to the housing of the plating cells illustrated in FIG. 1 and taken along line 17—17.

As shown in FIG. 17, one or more of the power supplies 24 is operatively connected to suitable electrical wires to the respective first and second terminals 82*a* and 82*b* to independently provide current paths thereto, and thereby provide negative, cathodic electrical potentials at the thief 34*d* and the workpiece 16. In the preferred embodiment illustrated in FIG. 1, two identical clamps 78 are provided with each being connected to a respective power supply 24. The respective first and second terminals 82*a,b* thereof thus provide independent current paths to the first and second receptacles 70*a,b* of both support blocks 68.

Figure 16:
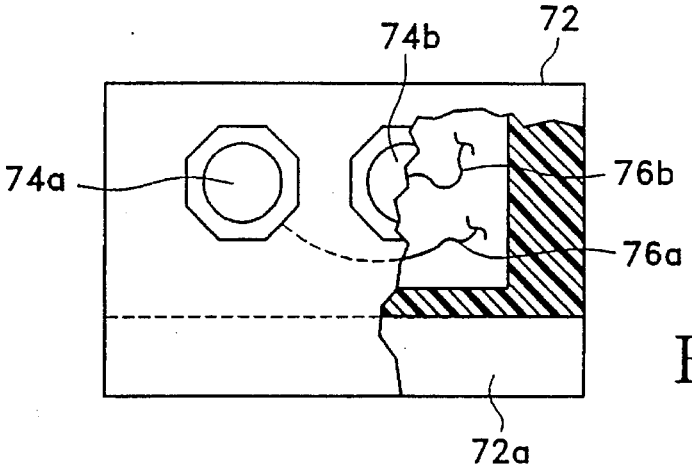
FIG. 16 is a partly sectional, elevational view of one of a pair of endcaps fixedly joined to the flybar illustrated in FIG. 12 and taken along line 16—16.
Figure 18:
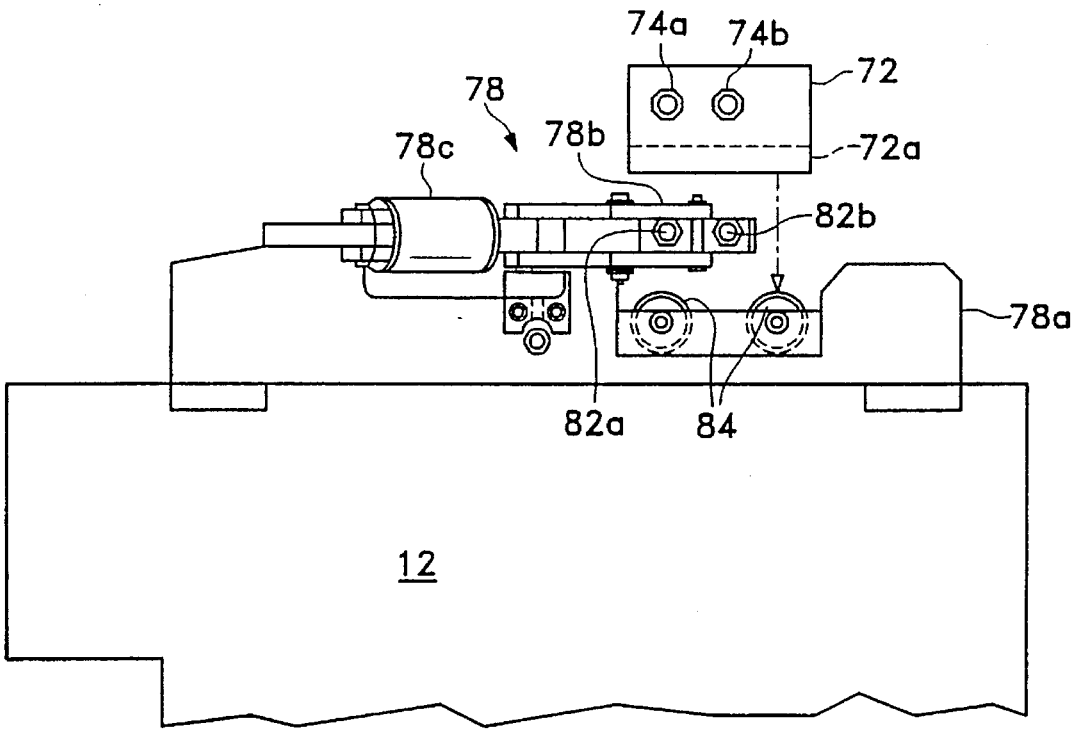
FIG. 18 is a side view of one of the clamps illustrated in FIG. 1 and taken along line 18—18.

As shown in FIG. 3 and described above, the fixtures 18 are loaded vertically downwardly into the plating cells 10 and then translated into abutting position against the inner cells 14 by the actuated piston 28. In order to accommodate this slight transverse movement of the fixtures 18, the flybar endcaps 72 are preferably seated atop a plurality of aligned wheels or rollers 84 which form saddles as illustrated in FIGS. 1, 17 and 18. As shown in more particularity in FIGS. 17 and 18, two pairs of the rollers 84 are disposed atop the plating cell 10 at opposite ends of the housing 12 thereof. The flybar endcaps 72 each includes a downward facing V-shaped groove 72*a* as shown in FIGS. 12, 16, and 18, which is so shaped for accurately resting on a respective pair of the rollers 84 for allowing rolling translation of the entire flybar 62 and the fixtures 18 suspended therefrom so that the pistons 28 may translate the fixtures 18 laterally into position as shown in FIG. 3. Once the fixtures 18 are positioned against the inner cells 14, the two clamps 78 illustrated in FIG. 1 may be actuated to engage the cooperating buttons 74*a,b* and terminals 82*a,b* for completing the separate electrical current paths and securely clamping the flybar 62 into position which prevents unintended movement thereof during the electroplating process.

Accordingly, in this exemplary first embodiment of the invention illustrated in FIGS. 1–18, the workpiece 16 may be readily vacuum-clamped to the workpiece holder 36; and readily assembled to the frame 34 for positioning the workpiece 16 coplanar with the auxiliary electrode thief 34*d*, with the contact pins 52 providing a current path to the workpiece 16. The assembled fixture 18 may be manually or robotically suspended on the flybar 62 by engaging the cooperating cones 58*a,b* and receptacles 70*a,b* which both support the fixture 18 as well as provide an automatic electrical connection therebetween. The fixtures 18 are readily loaded into the plating cells 10 by carrying the flybar 62 with the fixtures 18 suspended therefrom using the lifting hook 66 which may also be robotically controlled. When the fixtures 18 are loaded downwardly into the plating cells 10, the pistons 28 may be actuated for securing the fixtures 18 against the inner cells 14, and in turn the clamps 78 may then be actuated to lock the flybar 62 into position and complete the electrical current paths through the cooperating buttons 74*a,b* and terminals 82*a,b*. The electroplating process may then be completed for electrodepositing the desired metal film on the workpieces 16. The electroplated workpieces 16 may then be readily removed by reversing the assembly process.

Figure 19:
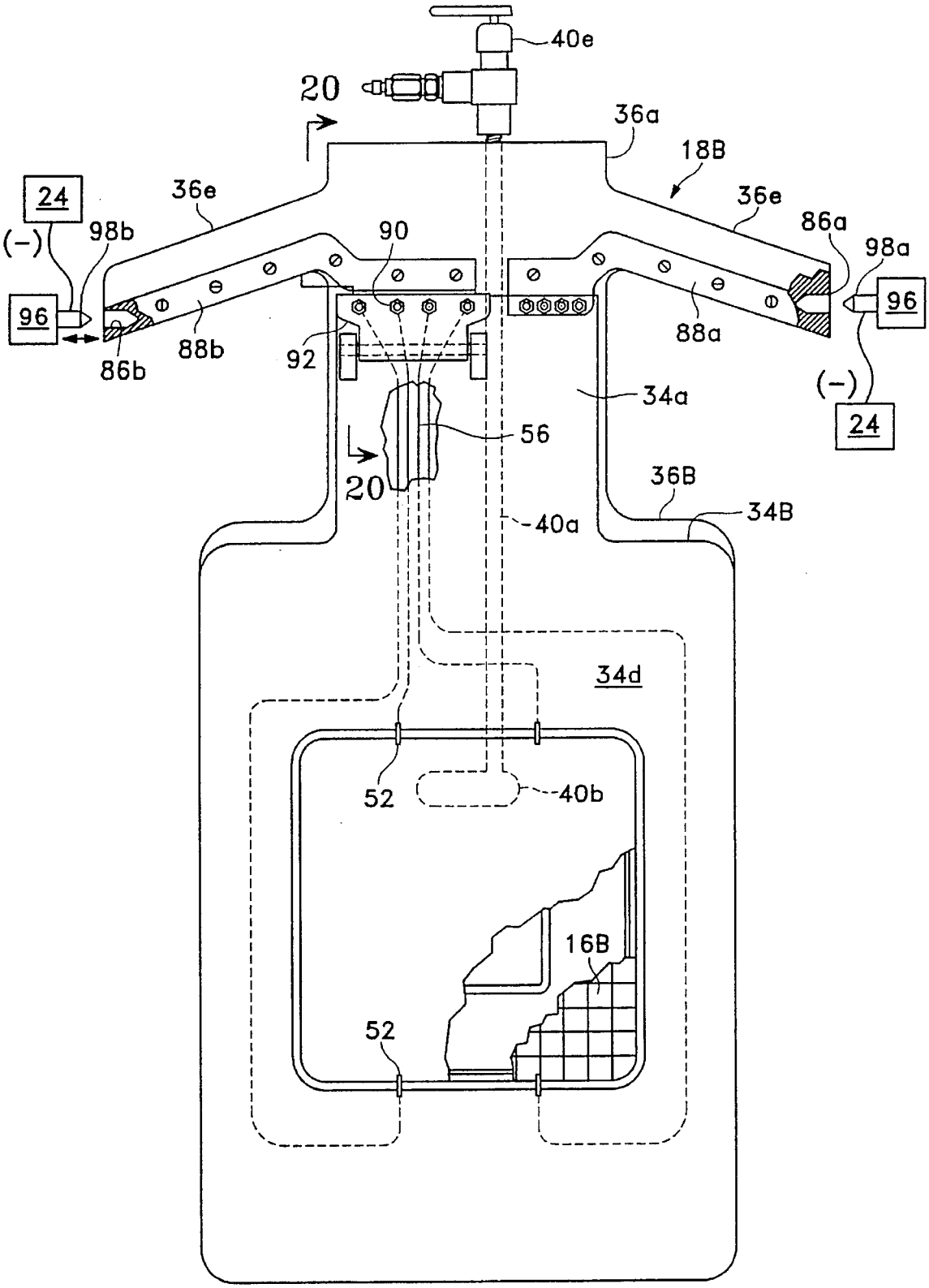
FIG. 19 is a partly sectional, elevational, schematic view of a workpiece fixture in accordance with another embodiment of the present invention having a pair of wing arms for suspending the fixture in the plating cell.
Figure 20:
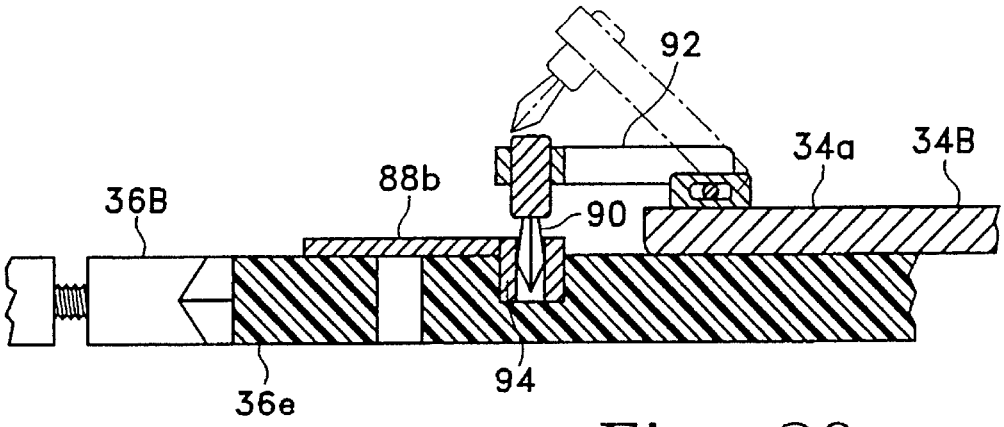
FIG. 20 is a partly sectional view of a top end of a frame and holder of the workpiece fixture illustrated in FIG. 19 and taken along line 20—20.
Figure 21:
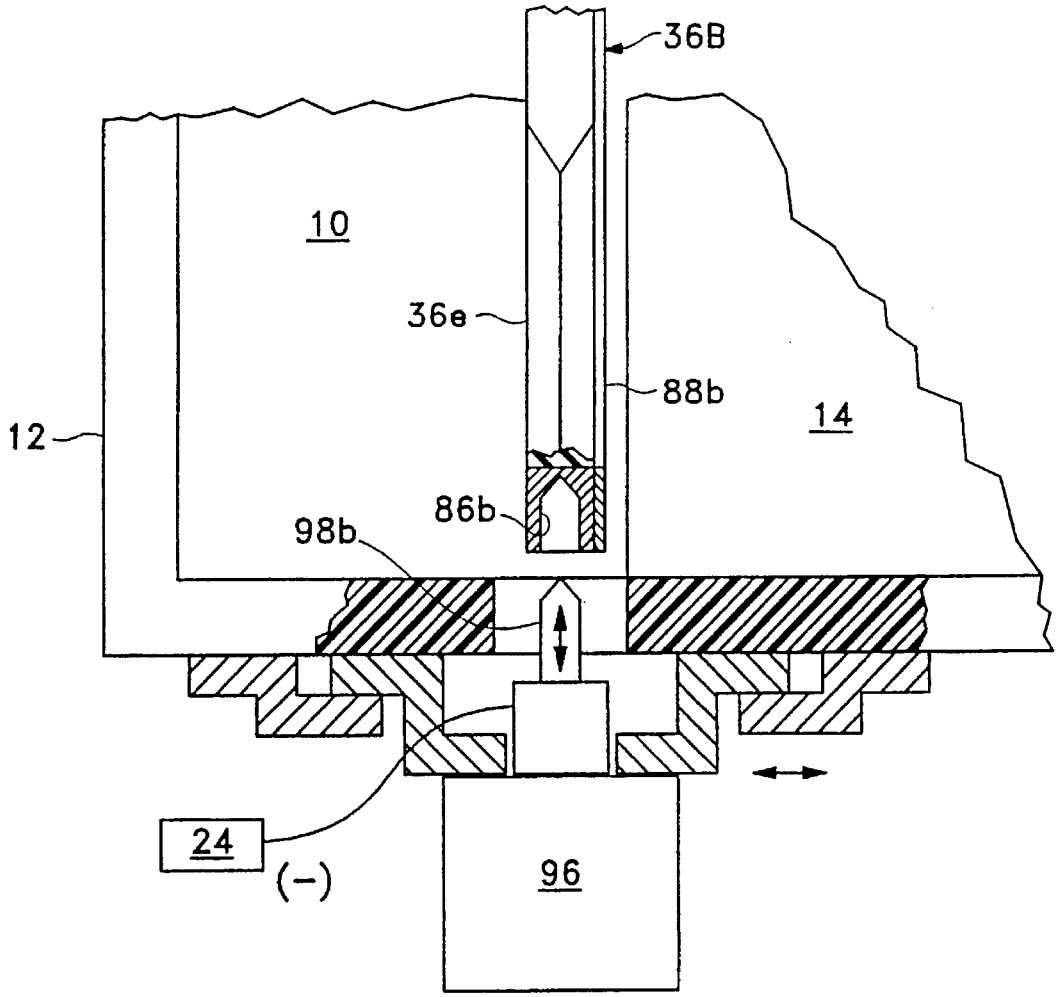
FIG. 21 is a top view of a portion of the winged fixture illustrated in FIG. 19 disposed in position in a plating cell having a cooperating actuator and pin for supporting and electrically connecting the workpiece fixture.

Illustrated in FIGS. 19–21 is a fixture in accordance with an alternate embodiment of the present invention and designated 18B. The fixture 18B includes a frame 34B and a holder 36B suitably modified for supporting a square workpiece 16B in a manner substantially identical to the support of the circular workpiece 16 described above, but having a different suspension system for supporting the fixture 18B.

More specifically, in this embodiment as illustrated in FIG. 19, the holder 36B includes a pair of wing arms 36*e* extending laterally outwardly from atop the holder stem 36*a*, with each wing arm 36*e* having respective first and second conical, electrically conducting seats 86*a* and 86*b*. The holder 36B is again preferably a dielectric such as PVDF, and therefore, a first electrically conducting bar 88*a* extends in electrical contact with and from the first seat 86*a* to the middle of the holder stem 36*a*. A second electrically conducting bar 88*b* is electrically joined to the second seat 86*b* and extends laterally inwardly to the middle of the holder stem 36*a*. The frame stem 34*a* is suitably electrically joined to the first conducting bar 88*a*, by a plurality of screws for example, for producing a separate current path to the thief 34*d* internally through the metallic frame 34B itself. The electrical lines 56 joined to the contact pins 62 are electrically joined to the second conducting bar 88*b* for providing a separate current path to the contact pins 52.

As shown in FIGS. 19 and 20, a plurality of banana plugs 90 are electrically joined to respective ones of the electrical lines 56 and are mounted in a hinged flap 92 which is suitably pivotally joined to the frame stem 34*a* for being removably inserted into respective ones of a plurality of sockets 94 disposed in the second conducting bar 88*b*. The plugs 90 are shown in FIG. 20 in solid line in engagement with the mating sockets 94 for providing an electrical path to the second seat 86*b*.

In order to suspend the fixture 18B and provide electrical paths thereto, a pair of identical actuators 96 are suitably slidably mounted to opposite sides of the housing 12, with each actuator 96 having a respective first and second conically tipped plunger 98*a* and 98*b* which is translatable inwardly and outwardly therefrom. Each of the plungers 98*a,b* is suitably electrically joined to the power supply 24 for providing independent current paths to the respective first and second seats 86*a,b* for effecting a negative potential thereat.

The fixture 18B may be suitably loaded into position into its respective plating cell 10, with the actuators 96 being suitably powered for extending the respective plungers 98*a,b* into abutting contact in their mating seats 86*a,b* in the respective wing arms 36*e* as shown in FIGS. 19 and 21. In this way, separate electrical current paths are established from the power supply 24 to the thief 34*d* and the workpiece 16B through the intermediary electrical joints therebetween. The plungers 98*a,b* also physically support the fixture 18B without the need for the flybar 62 in the first embodiment disclosed above.

The plugs 90 and hinged flap 92 allow the electrical wires 56 to be disconnected from the second conducting bar 88*b* so that electrical contact of each pin 52 to the workpiece 16 may be checked using pairs of the lines 56 as described above. In this embodiment as illustrated in FIG. 19, a manually closable vacuum valve 40*e* is used instead of the self closing, quick disconnect valve 40*c* disclosed above.

The two configurations of the fixture 18, 18B disclosed above indicate some of various alternate configurations which may be effectively used for accurately supporting and automatically electrically connecting the workpiece 16, 16B in the plating cell 10.

Although single circular and square workpieces 16, 16B have been disclosed above, the workpiece may have any suitable configuration. More than one workpiece may be mounted in each fixture 18 such as two with one above the other, or four spaced apart in a square grid, as well as other arrangements. Two workpieces 16 may also be supported on both, opposite sides of the fixture 18 if desired. The fixtures 18 may be used for electroless plating which would eliminate the need for the electrical paths therethrough; or may be modified for use in electroetching or chemical etching.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

1. A fixture for supporting a workpiece in a plating cell comprising:

a frame including a stem for removably positioning said frame into said plating cell, and a head, said frame head having a hole extending therethrough from front to back sides of said frame;

a holder having a plateau on a front side thereof for supporting said workpiece adjacent to a perimeter thereof;

said frame-head hole being complementary to said holder plateau and workpiece positionable thereon for receiving said plateau to align said workpiece with said frame front side therearound; and means for retaining said workpiece against said plateau.

2. A fixture according to claim 1 wherein said workpiece retaining means comprise:

an annular seal disposed adjacent said plateau perimeter;

a vacuum port disposed in said plateau inside said seal; and said plateau being sized for supporting said workpiece on said seal so that vacuum in said vacuum port fixedly holds said workpiece against said plateau.

3. A fixture according to claim 2 wherein said holder further comprises:

a stem and an integral head, and said plateau extends outwardly from said holder head;

a vacuum tube extending through said holder stem to said vacuum port in said plateau; and a valve disposed at a distal end of said holder stem in flow communication with said vacuum tube through which vacuum can be drawn and maintained between said workpiece and plateau for releasably holding said workpiece thereto.

4. A fixture according to claim 2 wherein said frame further comprises:

an auxiliary electrode thief disposed on said front side of said frame head around said frame-head hole;

a plurality of electrical contact pins circumferentially spaced apart around said frame-head hole for electrically contacting said workpiece when said holder is joined to said frame; and separate electrical current paths to said thief and said contact pins.

5. A fixture according to 4 wherein:

said frame is formed of electrically conducting material and provides an integral electrical current path to said thief; and said frame further comprises a plurality of electrical lines joined to respective ones of said contact pins for providing separate current paths thereto.

6. A fixture according to claim 5 wherein said frame further comprises:

first and second electrical contact cones fixedly joined to a distal end of said frame stem, and being aligned parallel with said frame stem and pointing toward said frame head;

said first cone being electrically joined to said frame stem for providing said current path to said thief; and said second cone being electrically joined to said plurality of electrical lines for providing said current paths to said contact pins.

7. A fixture according to claim 6 wherein said holder further comprises:

a stem and an integral head, and said plateau extends outwardly from said holder head;

a vacuum tube extending through said holder stem to said vacuum port in said plateau; and a valve disposed at a distal end of said holder stem in flow communication with said vacuum tube through which vacuum can be drawn and maintained between said workpiece and plateau for selectively holding said workpiece thereto.

8. A fixture according to claim 7 further comprising means for releasably fixedly joining said holder to said frame, with said plateau being disposed in said frame-head hole, said joining means comprising:

a plurality of snap plugs fixedly joined to, and spaced apart on, said back side of said frame; and a plurality of snap holes disposed in said holder and being complementary to said snap plugs for releasably engaging said snap plugs for releasably joining said holder to said frame.

9. A fixture according to claim 8 in combination with a flybar comprising:

an elongate support beam sized for straddling said plating cell;

a pair of endcaps fixedly joined to opposite ends of said beam, and at least one of said endcaps having first and second electrical contact buttons thereon;

a support block fixedly joined to an intermediate section of said beam, and including first and second electrically conductive conical receptacles electrically joined to respective ones of said first and second buttons; and said first and second receptacles being disposed on said block to face upwardly for receiving downwardly therein respective ones of said first and second cones for both suspending said fixture by said frame and for providing automatic electrical contact by joining together in abutting contact said first cone and said first receptacle, and said second cone and said second receptacle.

10. A combination according to claim 9 wherein said flybar further comprises a pair of axially spaced apart support hangers fixedly joined thereto for lifting said flybar and in turn said fixture.

11. A fixture according to claim 6 in combination with a flybar comprising:

an elongate support beam sized for straddling said plating cell;

a pair of endcaps fixedly joined to opposite ends of said beam, and at least one of said endcaps having first and second electrical contact buttons thereon;

a support block fixedly joined to an intermediate section of said beam, and including first and second electrically conductive conical receptacles electrically joined to respective ones of said first and second buttons; and said first and second receptacles being disposed on said block to face upwardly for receiving downwardly therein respective ones of said first and second cones for both suspending said fixture by said frame and for providing automatic electrical contact by joining together in abutting contact said first cone and said first receptacle, and said second cone and said second receptacle.

12. A combination according to claim 11 further comprising:

a clamp positionable atop said plating cell and including first and second electrical supply terminals; and said clamp being selectively positionable to clamp said flybar in axial compression, with said first button and said first terminal abutting together to establish said current path to said thief, and said second button and said second terminal abutting together to establish said separate current paths to said contact pins.

13. A combination according to claim 11 in further combination with said plating cell and further comprising:

a plurality of rollers disposed atop said plating cell at opposite ends thereof; a V-shaped groove facing downwardly in each of said flybar endcaps for resting on respective pluralities of said rollers for allowing rolling translation of said flybar therealong;

a pair of clamps positioned atop said plating cell on opposite sides thereof adjacent to said rollers, at least one of said clamps including first and second electrical supply terminals;

a power supply operatively joined to each of said first and second terminals for independently carrying current therethrough; and said clamp being selectively positionable to clamp said flybar in axial compression, with said first button and said first terminal abutting together to establish said current path to said thief, and said second button and said second terminal abutting together to establish said separate current paths to said contact pins.

14. A combination according to claim 13 wherein each of said clamps comprises:

a clamping arm pivoted at an intermediate portion thereof; and an actuator operatively joined to a proximal end of said clamping arm, and effective for pivoting said clamping arm to engage said flybar endcap in axial compression.

15. A fixture according to claim 5 wherein:

said holder further includes:

a stem and an integral head, and said plateau extends outwardly from said holder head;

a vacuum tube extending through said holder stem to said vacuum port in said plateau;

a valve disposed at a distal end of said holder stem in flow communication with said vacuum tube through which vacuum can be drawn and maintained between said workpiece and plateau for selectively holding said workpiece thereto; and a pair of wing arms extending laterally outwardly from atop said holder stem, each wing arm having a conical seat therein and an electrical conducting bar extending from said conical seat to said holder stem; and said frame stem is electrically joined to a first one of said conducting bars for providing said current path to said thief, and said contact pin electrical lines are electrically joined to a second one of said conducting bars for providing a separate current path to said contact pins.

16. A fixture according to claim 15 further comprising:

a plurality of sockets disposed in said second conducting bar; and a plurality of plugs electrically joined to respective ones of said electrical lines and pivotally joined to said frame stem for being removably inserted into respective ones of said sockets.

17. A fixture according to claim 1 wherein said holder further comprises generally V-shaped side edges for being releasably held in a robotic grip.

18. A fixture according to claim 1 further comprising means for releasably fixedly joining said holder to said frame, with said plateau being disposed in said frame-head hole.

19. A fixture according to claim 18 wherein said holder joining means comprise:

a plurality of snap plugs fixedly joined to, and spaced apart on, said back side of said frame; and a plurality of snap holes disposed in said holder and being complementary to said snap plugs for releasably engaging said snap plugs for releasably joining said holder to said frame.

* * * * *